United States Patent [19]

Weigl

[11] B 4,000,908

[45] Jan. 4, 1977

[54] SKI BINDING COMPONENT

[75] Inventor: Erwin Weigl, Brunn am Gebirge, Austria

[73] Assignee: Gertsch AG, Zug, Switzerland

[22] Filed: Jan. 22, 1974

[21] Appl. No.: 435,570

[44] Published under the second Trial Voluntary Protest Program on March 16, 1976 as document No. B 435,570.

[30] Foreign Application Priority Data

Jan. 22, 1973 Austria ..... 517/73

[52] U.S. Cl. ..... 280/623; 280/634

[51] Int. Cl.[2] ..... A63C 9/08

[58] Field of Search ..... 280/11.35 T, 11.35 R, 280/11.35 H, 11.35 A; 248/509, 507

[56] References Cited

UNITED STATES PATENTS

| | | | |
|---|---|---|---|
| 3,436,089 | 4/1969 | Beyl | 280/11.35 T |
| 3,442,525 | 5/1969 | Heckl | 280/11.35 T |

FOREIGN PATENTS OR APPLICATIONS

| | | |
|---|---|---|
| 1,188,487 | 3/1965 | Germany |
| 72,496 | 8/1947 | Norway |
| 526,318 | 9/1972 | Switzerland |

*Primary Examiner*—Robert R. Song
*Attorney, Agent, or Firm*—Woodhams, Blanchard and Flynn

[57] ABSTRACT

Sole holder component for a ski binding. A vertically movable sole holder is provided with a row of vertically arranged ratchet teeth and is spring biased into its upward position. At least one sidewardly movable slide is engageable with said ratchet teeth for holding same against upward movement and said slide is spring biased into such engaged position. Means manually operable are provided for manual withdrawal of said slide and consequent release of said sole holder when desired.

8 Claims, 10 Drawing Figures

SKI BINDING COMPONENT

FIELD OF THE INVENTION

The invention relates to a ski binding component, as a front jaw, heel holder or the like, having a sole holder which is vertically adjustable on the base member of the housing of the binding component, wherein there is provided lockable teeth between the base member or the housing of the binding component and the sole holder.

BACKGROUND OF THE INVENTION

In a known locking mechanism of the type mentioned above, an eccentric pin is supported rotatably but non-releasably in the base member and is embraced by a shoulder of the sole holder. Thus in one position of the eccentric pin the sole holder is urged against the base member so that the teeth engage. In order to rotate the eccentric pin, one must use a suitable tool which fits into a slot in the pin. A further disadvantage of this construction is that the sole holder can be adjusted only in a boot-free condition, namely when the boot is not clamped into the binding. This is due to the arrangement of the teeth. Therefore in most cases during a fitting a repeated adjustment of the sole holder with respect to the boot sole is required. Also prior to the adjustment, snow, dirt or the like must be cleaned from the teeth because the latter are arranged open on the base member.

SUMMARY OF THE INVENTION

The purpose of the invention is accordingly to avoid these disadvantages and the invention is characterized in that the base member or the housing of the sole holder has a vertically arranged set of ratchet teeth and that on the other part at least one slide is provided, which slide is movable in an approximately horizontal guide and which slide in its position of use engages with at least one of the ratchet teeth and wherein the slide engages or is connected to a release latch and the sole holder is supported on a spring which loads said sole holder upwardly.

The teeth can be released by operating the release latch without any additional means so that the sole holder is automatically urged upwardly by elastic means and is locked automatically after movement into the position which corresponds to the thickness of the boot sole. Furthermore the adjustment can take place with the boot clamped in place, whereby a quick and exact adjustment of the sole holder to the boot sole is possible. Also by installing this adjusting mechanism into the base member or the sole holder of the ski binding penetration of snow, dirt or the like thereinto is avoided.

BRIEF DESCRIPTION OF THE DRAWINGS

The subject matter of the invention is illustrated by several exemplary embodiments in the drawings, in which:

FIGS. 5 and 6 are associated views of a further exemplary embodiment, wherein FIG. 6 is a cross-sectional view taken along the line VI—VI of FIG. 5.

FIGS. 8–10 illustrate a further construction, wherein FIG. 8 is a top view, FIG. 9 a cross-sectional view along the line IX—IX of FIG. 8 and FIG. 10 is a cross-sectional view along the line X—X of FIG. 8.

DETAILED DESCRIPTION

Figure 2:
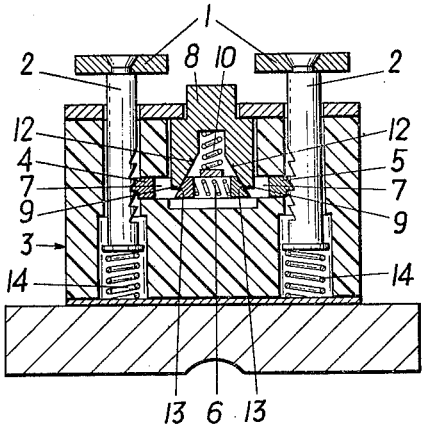
FIG. 2 is a cross-sectional view taken along the line II—II of FIG. 1.

As shown in FIGS. 1–4, the sole holder 1 is movably supported in the base member 3 of the ski binding component by means of two pins 2. The pins 2 each have ratchet teeth which are engaged by two slides 4, 5, one with each group of teeth. The slides 4, 5 are constantly urged by a spring 6 against the teeth of the pins 2. They also have an opening 7 into which extends a release latch 8 having arms 9. The release latch 8 is loaded by a spring 10 which constantly urges it towards its initial position.

Figure 3:
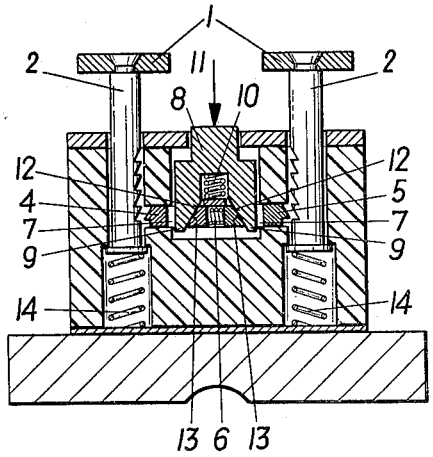
FIG. 3 is the same cross-sectional view as FIG. 2 in a released position.
Figure 1:
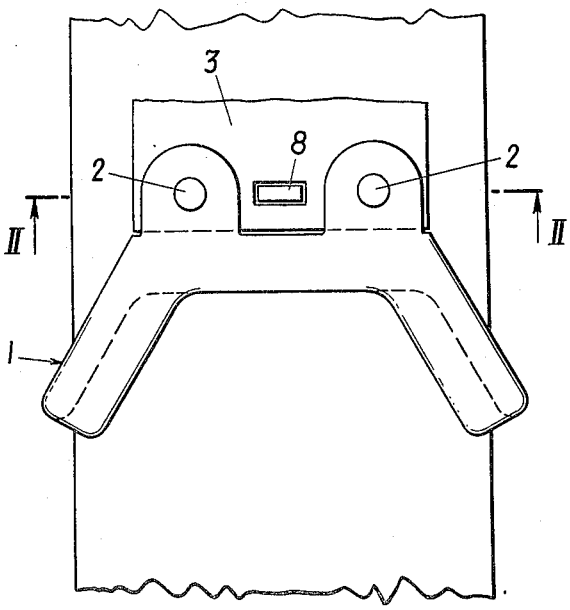
FIG. 1 is a top view of a ski binding.

FIG. 3 illustrates the mechanism in a released condition. Herein the release latch 8 is moved in the direction of the arrow 11. This causes the arms 9 to press with their sloped surfaces 12 against the sloped surfaces 13 in the openings 7 of the slides 4, 5, and release same against the force of the spring 6 from the teeth of the pins 2. This permits the two pins 2 to respond to the two springs 14 for moving the sole holder upwardly into an initial position.

Figure 4:
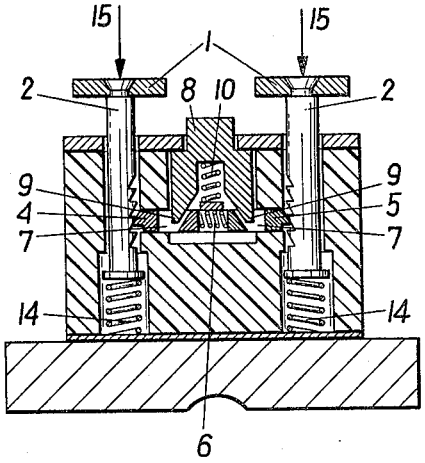
FIG. 4 is also a cross-sectional view, the same as FIG. 2, during an adjustment of the sole holder.

FIG. 4 illustrates the ski binding component during an adjusting of the sole holder 1 to the boot sole. This is achieved by moving the sole holder 1 in the direction of the arrows 15. The teeth of the pins 2 slide over the teeth of the slides 4, 5 and move these against the force of the spring 6 toward the center. When the required position of the sole holder 1 is reached, the slides 4, 5 engage the teeth of the pins 2 and hold same in the desired position.

Figure 6:
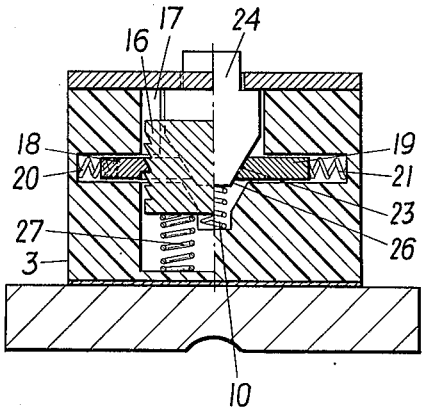
Figure 7:
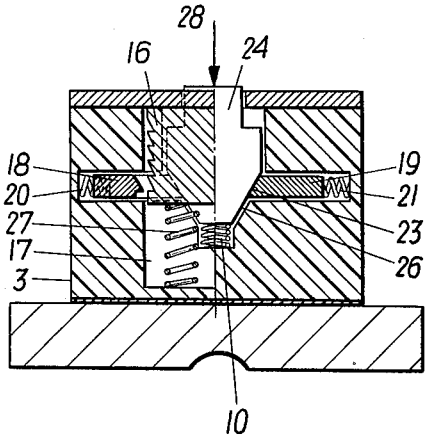
FIG. 7 is the same cross-sectional view as FIG. 6 in a released position.
Figure 5:
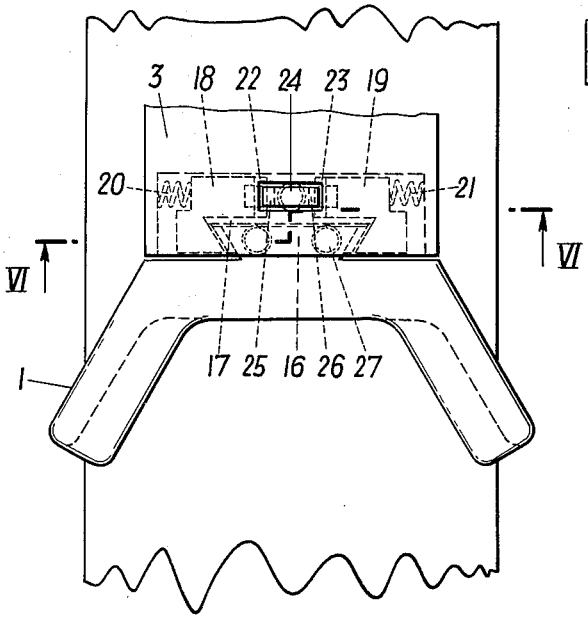

In the construction according to FIGS. 5 and 6, the sole holder 1 is provided with a ratchet toothed dovetail 16 which slides in a guide 17 positioned in the base member 3 of the ski binding. Two slides 18, 19 engage the teeth of the dovetail 16, which slides are each biased by springs 20, 21. The slides 18, 19 have each a sloped surface 22, 23 on which abuts a release latch 24 with its sloped surfaces 25, 26. The release latch 24 is the same as in the first exemplary embodiment loaded by a spring 10 which returns it after operation into its initial position. Also the sole holder 1 is biased by two springs 27. FIG. 7 illustrates the release of the mechanism according to FIGS. 5 and 6. The release latch 24 is moved in the direction of the arrow 28. It now presses with its sloped surfaces 25, 26 against the sloped surfaces 22, 23 of the slides 18, 19 and moves same back against the force of the springs 20, 21, so that the teeth of the slides 18, 19 disengage from the teeth of the dovetail 16. This permits the sole holder 1 to move upwardly in response to the springs 27 into its initial position. The adjustment of the sole holder 1 to the boot sole occurs in the same manner as in the exemplary embodiment according to FIGS. 1–4.

Figure 9:
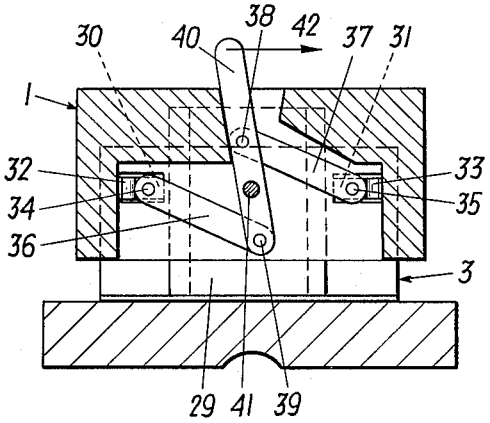
Figure 10:
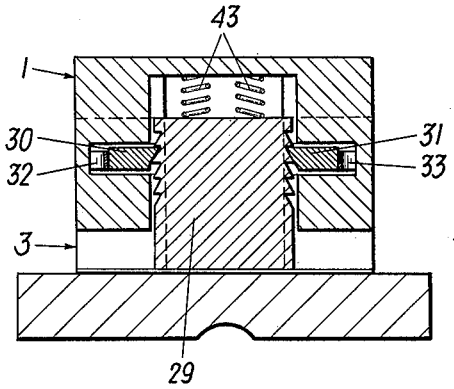
Figure 8:
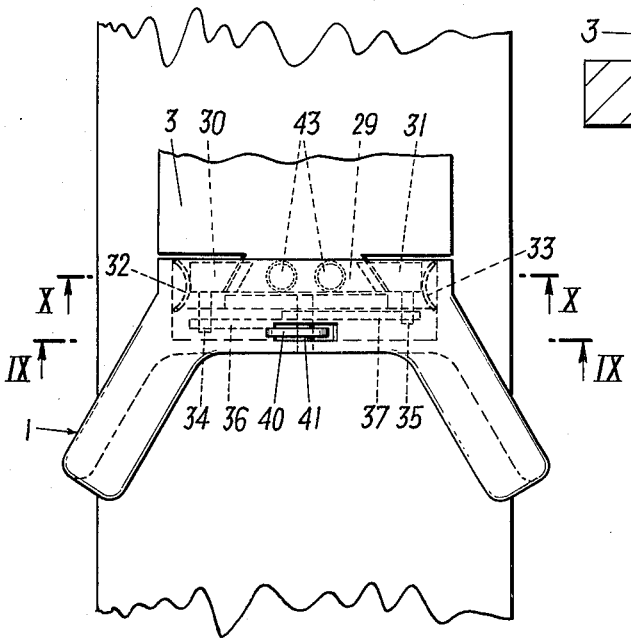

In the construction according to FIGS. 8–10, the adjusting mechanism is installed in the sole holder 1. At the front end of the base member 3 of the ski binding component, which end faces the sole holder 1, a dovetail 29 is provided which is provided with ratchet teeth. Two slides 30, 31 engage these teeth and are urged into such engagement by the two leaf springs 32, 33. Two pins 34, 35 are provided on the slides 30, 31, on which pins two levers 36, 37 are pivotally arranged. Said levers are also pivotally connected to the release latch 40 by means of two further pins 38, 39. The release latch 40 is pivotally supported on a pin 41 in the sole holder 1. In order to release the ski binding component, the release latch 40 is moved in direction of the arrow 42. This causes the two levers 36, 37 to move the slides 30, 31 against the force of the springs 32, 33 outwardly so that they disengage from the teeth of the dovetail 29 of the base member 3 of the ski binding. Thus the sole holder 1 is also moved upwardly into its initial position by the springs 43. The adjustment to the boot sole thickness again is made as in the preceding examples.

The invention is not limited to the illustrated exemplary embodiments. A number of possible further embodiments exist which lie within the scope of the invention. For example it would be possible in the first construction to form the teeth of the pins also of annular grooves or a thread. It would also be possible to provide the slides with multiple teeth. Furthermore, it is possible to use only one slide which acts in the center of the sole holder.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are as follows:

1. A ski binding device for holding at least one of the toe and heel of a ski boot into engagement with an upper surface of a ski, comprising:

base means mounted on said ski and having at least vertical guide means thereon;

vertically movable ski boot engaging means vertically movably mounted on said vertical guide means, at least one of said base means and said ski boot engaging means having horizontal guide means thereon intersecting said vertical guide means;

movable first lock means movably mounted on said horizontal guide means, said ski boot engaging means having second lock means cooperable with said first lock means to effect securement of said vertically movable ski boot engaging means in a selected position relative to said ski;

resilient means for continuously resiliently biasing said ski boot engaging means in a vertically upward direction; and release means operatively connected to said first lock means for effecting a movement of said first lock means out of cooperating relation with said second lock means to permit a vertical movement of said ski boot engaging means relative to said ski and said ski boot due to the urging of said resilient means.

2. A ski binding device according to claim 1, wherein said horizontal guide means is on said base means.

3. A ski binding device according to claim 2, wherein said operative connection in said release means includes latch means and spring means for resiliently urging said latch means out of engagement with said first lock means to maintain said securement between said first and second lock means, said latch means having surface means engaging said first lock means and effecting a movement of said first lock means away from said second lock means during a movement of said latch against the urging of said spring means.

4. A ski binding device according to claim 1, wherein said horizontal guide means is on said ski boot engaging means.

5. A ski binding device according to claim 4, wherein said operative connection in said release means includes at least two levers, a first one of which is pivotally secured to said ski boot engaging means, one end of said first of said levers being manually engageable by the user thereof, a second of said levers extending between and being pivotally secured to said first lever and said first lock means whereby a pivoting of said first lever will effect a movement of said first lock means.

6. A ski binding device according to claim 4, wherein said operative connection in said release means includes three levers, a first one of which is pivotally secured to said ski boot engaging means, one end of said first of said levers being manually engageable by the user thereof, a second and third of said levers each extending between and being pivotally secured to said first lever and said first lock means; and wherein said first lock means includes a pair of slides mounted for horizontal movement in said horizontal guide means each having one of said second and third levers pivotally secured thereto.

7. A ski binding device according to claim 1, wherein said first lock means includes a pair of sliders and a spring means for resiliently urging said pair of sliders into locking engagement with said second lock means.

8. A ski binding device according to claim 1, wherein said first and second lock means include members each having at least one tooth thereon cooperating with the tooth of the other to secure said ski boot engaging means against vertical upward movement.

* * * * *